United States Patent [19]

Long

[11] Patent Number: 4,980,929

[45] Date of Patent: Jan. 1, 1991

[54] LONG-SLEEVED GARMENT WITH INTEGRATED ANIMAL DESIGN AND PUPPET-LIKE SLEEVE

[76] Inventor: Marla M. Long, 1486 McTaggart Rd., Stow, Ohio 44224

[21] Appl. No.: 351,210

[22] Filed: May 15, 1989

[51] Int. Cl.[5] ..... A41B 1/08

[52] U.S. Cl. ..... 2/125; 2/158; 446/329

[58] Field of Search ..... 2/1, 75, 125, 158; 446/26, 28, 327, 328, 329; D2/79, 80, 81, 82, 84, 208, 209, 213, 214, 215, 216, 222

[56] References Cited

U.S. PATENT DOCUMENTS

| | | | |
|---|---|---|---|
| D. 99,368 | 4/1936 | Raimer | 3/26 |
| 99,369 | 4/1936 | Raimer | 3/26 |
| D. 107,184 | 11/1937 | Buffett | D2/215 |
| D. 217,654 | 5/1970 | Ryland | 446/329 |
| D. 268,222 | 3/1983 | Chen | 2/158 |
| 361,250 | 4/1887 | Wright | 2/125 |
| 1,092,047 | 3/1914 | Hertz | 2/158 |
| 1,183,792 | 5/1916 | Aron | 2/158 |
| 1,296,966 | 3/1919 | Kaufman | 2/158 |
| 2,323,136 | 6/1943 | Johanson | 2/158 |
| 2,677,130 | 5/1954 | O'Hayer | 2/75 |
| 2,795,896 | 6/1957 | Snyder | 446/329 |
| 3,226,849 | 1/1966 | Rosen | 446/329 |
| 3,308,479 | 3/1967 | Sesco | 446/327 |
| 3,447,165 | 6/1969 | Brosk | 446/327 |
| 4,244,142 | 1/1981 | Crawford | 446/329 |
| 4,280,292 | 7/1981 | Hills | 446/28 |
| 4,759,084 | 7/1988 | Madnick | 2/158 |
| 4,799,889 | 1/1989 | Yockey | 446/328 |

*Primary Examiner*—Werner H. Schroeder
*Assistant Examiner*—Diana L. Biefeld
*Attorney, Agent, or Firm*—Ronald P. Kananen

[57] ABSTRACT

A shirt-like garment having an upper body torso merging into a sleeve portion wherein a figure is applied to the torso portion and to the sleeve portion to appear as an integrated image. The sleeve preferably terminates in a puppet head at its distal end so that a wearer may insert a hand into the puppet head for manipulation as a convention puppet. The mouth of the puppet head is preferably formed with upper and lower inner mouth pieces defining a slot through which a hand of a wearer may extend free from the puppet head. When so extended, the puppet head will be fastened about the wrist of the wearer by suitable fasteners.

15 Claims, 2 Drawing Sheets

10
12
13
14
15
16
18
20
22
24
26
28
30
32
38
50
52a
52b
54a
54b
56
58
7

FIG. 6
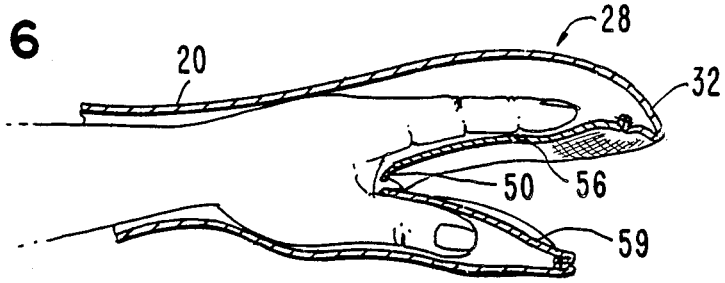
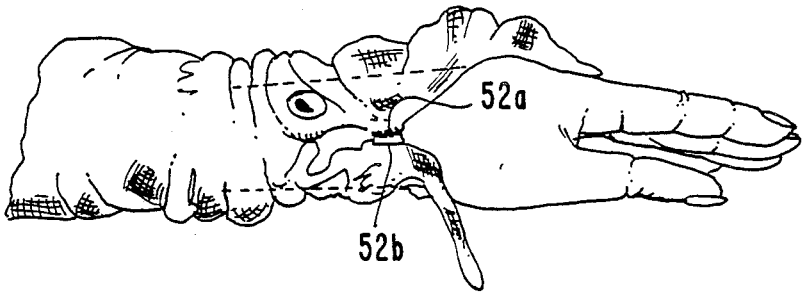
FIG. 7
FIG. 8
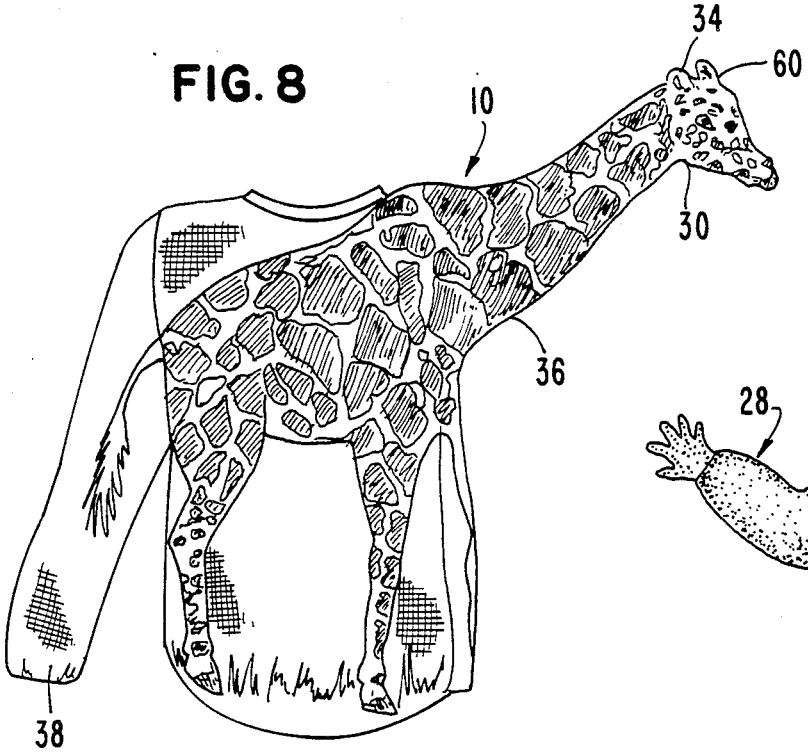
FIG. 9
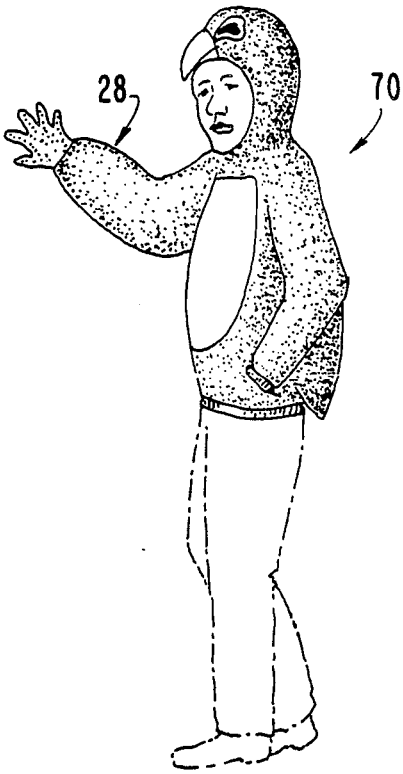

LONG-SLEEVED GARMENT WITH INTEGRATED ANIMAL DESIGN AND PUPPET-LIKE SLEEVE

BACKGROUND OF THE INVENTION

This invention relates to an article of clothing useful as a novelty item. More particularly, this invention relates to a long-sleeved garment having an animal design applied to the body of the garment and a sleeve terminating in a puppet-like figure. Still more particularly, this invention relates to a garment having a hand-accommodating sleeve end formed as a puppet head.

It is common and quite popular to imprint a design on the body of a garment such as a tee-shirt, blouse, shirt, and the like wherein the design appears on the body-girdling portion of the garment. For adults, such garments are popular for displaying products of adult interest, or resorts, and the like. For children, such designs often take the form of cartoon or television characters, or individually-created characters which are acceptable and recognizable to children. Chickens, dinosaurs, bears, and other animal characters are generally popular with children. Examples of such once-patented designs are found in Des. Pat. No. 99,369 and in Des. Pat. No. 99,368. Such designs are generally applied to short-sleeved garments. However, even when long-sleeved garments are produced, the design does not usually extend to a major portion of the sleeve.

On the other hand, puppet characters have been popular with children for many years. Regularly, puppet shows are held wherein the puppeteer uses a mitten-like structure formed as a puppet character which is manipulated to words and music. Television has regularly provided puppets to children which are appealing to their sense of fancy. An example of such a garment in the patent literature is found in U.S. Pat. No. 3,308,479, while U.S. Pat. No. 3,447,165 shows an illustrative example of a mitten and character combination.

Moreover, wholly aside from the designs and puppets discussed above, garment sleeves have taken a variety of shapes and forms for various purposes over the years. Certain sleeve ends have taken on a convertible character so that the hand of the wearer can be selectively covered or exposed. Such structures are functional in nature and not associated with a puppet-like character or as a part of the aesthetic design of the garment. Representative examples of such structures are shown in U.S. Pat. Nos. 361,250; 1,092,047; and 1,183,792. On the contrary, however, U.S. Pat. No. 2,323,136 shows a convertible mitten which in one embodiment may be used for silhouetting characters.

None of the noted art suggests or teaches a combination of a garment with a design integrated into the sleeve, wherein the sleeve end is formed as a part of the design character or is useful as a puppet. Thus, a primary object of this invention is to provide a garment of the type described comprising a long-sleeved upper torso garment having a hand-accommodating sleeve end and an animal design applied to the torso portion of the garment.

It is an additional object of the invention to provide a garment of the type described wherein the garment is in the form of a shirt, sweater, or blouse having long sleeves and a mitten-like attachment on one or both sleeves.

It is still another object of this invention to provide such a garment with an animal design arranged so that the head of animal extends down the sleeve of the garment and the body of the animal appears on the torso portion of the garment, a dinosaur, flamingo, or giraffe being representative of the types of creatures which are particularly suited for such integration with the garment because of their elongated neck structures.

It is another object of this invention to provide a garment with a sleeve terminating in a mitten-like sleeve end formed as the head of a hand-held puppet-like character, wherein the sleeve end is split transversely at a location spaced from the puppet-like sleeve end to permit a hand of the user to protrude from the slot so that the garment can be worn in a conventional manner with the hands of the wearer being free from envelopment by the garment.

It is still another object of the invention to provide a slotted garment of the type described immediately above, which is formed by pair of flaps, each having a portion attached along its perimeter to form a pouch that opens away from the cuff on the inside of the sleeve.

It is still another object of the invention to provide a slotted garment of the type described immediately above, which includes fasteners attached on the sides of the inner face of one pouch and on the outside edge of the other pouch, wherein the head of the encrypted animal forms a puppet mouth.

These and other objects of the invention will become apparent from a written description of the invention which follows, taken in conjunction with the accompanying drawings.

BRIEF SUMMARY OF THE INVENTION

Directed to achieving the foregoing objects and overcoming problems in the prior art, the invention comprises an article of manufacture. The article includes a garment structurally adapted for being worn on the upper torso of a human, comprising an upper torso portion which includes at least one long sleeve secured thereto, the garment including a design imprinted on the garment so that a portion of the design is contained on the upper torso portion of the garment while an integrated portion of the design is applied to the sleeve. The upper torso portion is made from a front body piece and a back body piece suitably fastened, such as by sewing.

Preferably, the sleeve terminates in a mitten-like portion, such as a puppet head sleeve piece, which is formed as the head of an animal figure. The animal figure can thus be manipulated by the hand of the wearer when inserted into the mitten-like puppet portion. In a preferred embodiment, the terminal portion of the sleeve comprises a pair of flaps, such as upper and lower inner mouth pieces, secured about at least a portion of their perimeter to define a slot through which a hand of the user may exit when desired.

The animal design which is integrated between the upper torso portion of the document may take any of a number of suitable forms. However, long-necked animals such as flamingos, giraffes, snakes, camels, and dinosaurs, and a trunked animal such as an elephant are particularly suited.

The upper torso garment may take a number of forms, such as an open neck garment or a hooded garment. If desired, both sleeves can be configured as described above, although one sleeve will usually be a regular sleeve piece.

These and other features of the invention will become further apparent from the written description of the invention which follows.

BRIEF DESCRIPTION OF THE DRAWINGS

In the drawings:

FIG. 6 is a fragmentary partial sectional longitudinal view of the distal end of the sleeve with the hand of the wearer in its puppet-manipulating position;

FIG. 7 is a sectional view taken along line 7—7 of FIG. 3;

FIG. 8 is an illustrative view of another animal character, wherein the puppet head is three-dimensionally sculptured; and FIG. 9 is an illustrative view of still another animal character in an alternative illustrative form of the garment, i.e. a hooded pullover.

DETAILED DESCRIPTION OF THE PREFERRED EMBODIMENTS

Figures 1, 2, 3, 4, 5:
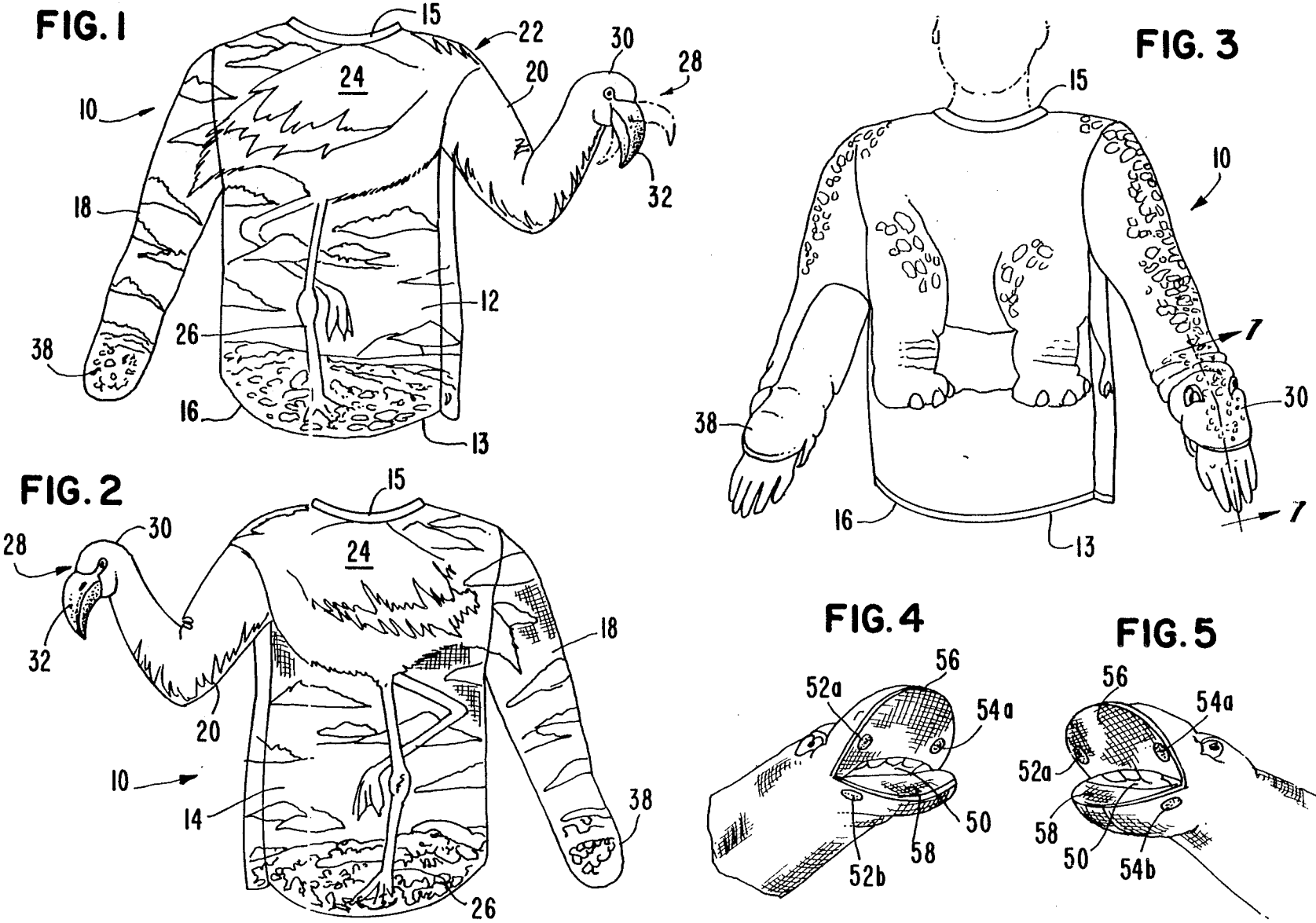
FIG. 1 is a front version of the upper torso garment according to the invention showing a flamingo design.
FIG. 2 is a rear version of the upper torso garment according to the invention as shown in FIG. 1.
FIG. 3 is a frontal view of a garment such as in FIGS. 1 and 2 with a different animal design and showing the puppet head at the terminal end of the sleeve in a retracted position so that the hand of the wearer may extend through a slit in the end.
FIG. 4 is a perspective view of the puppet head construction at the terminal end of a sleeve with the puppet mouth in an open position and securing tabs unlatched.
FIG. 5 is another view of the puppet head at the terminal head of the sleeve showing the flaps forming a slot, i.e. an arm hole, through which a hand of the wearer may extend.

A representative example of the garment according to the invention is shown in FIGS. 1 and 2 at the reference numeral 10. The garment 10 is in the form of an upper torso tee-shirt having an upper torso portion 12 structurally adapted and sized to be worn on the upper body of a person, whether an adult or a child. The upper torso portion 12 is made from a front body piece 13 and a back body piece 14 (see FIG. 2) sewn or otherwise suitably secured. The garment 10 includes a neck portion 15 through which the neck and head of a wearer extend when the garment is worn, and a shirttail or bottom portion 16 opposite from the neck portion 15. The garment 10 further includes a right sleeve 18, generally referred to as a puppet head sleeve piece, and a left sleeve 20, generally referred to as a regular sleeve piece sewn to the garment in a conventional manner.

A design 22 is applied to the garment 10 in a conventional manner such as by silk screening, hand painting, or the like in such a way that the design is integrated between the upper torso portion 12 of the garment 10 and at least the left sleeve portion 20. In the embodiment illustrated in FIGS. 1 and 2, the design is that of a flamingo having its body portion 24 and legs 26 applied to the upper torso portion 12 of the garment 10 and its neck and head portion applied to the sleeve 20. The right sleeve 18 may also be integrated into the design.

Preferably, the sleeve 20 terminates at its distal end 28 in a puppet-head-like portion 30 representing a head of a flamingo. The garment 10 and in particular the sleeve 20 are thus adapted so that a hand of the wearer may be enclosed by the puppet-like-head portion 30 of the sleeve 20. When the hand of the wearer is so enclosed within the head 30 of the sleeve 20, the head 30 may be manipulated in a puppet-like fashion as is conventional in puppeteering. The particular puppet-head portion 30 may include additional structure such as a beak 32 for the flamingo, or as shown in FIG. 8, with ears 34 for a giraffe 36.

Structurally, the sleeve 20 is preferably slightly longer than the sleeve 18, although the sleeves may also be approximately the same lengths. It may also be noted from FIG. 2 which is a view of the garment 10 from the side opposite to that shown in FIG. 1 that the design is continued on that side as well. With an image of the neck and head of the animal applied to the sleeve 20, the animal image is seen "in the round", and also permits the garment to be worn to allow manipulation of the puppet head by either hand. Thus, the "front" may act as the "back" and vice versa.

In use, a wearer dons the garment in a conventional manner so that a right arm and hand are nestled within the right sleeve 18 and a left arm and hand are nestled within the left sleeve 20. The left hand is inserted into and within the head portion 30 of the left sleeve so that the head of the flamingo may be manipulated while the garment is being worn. Such as garment has utility as a novelty item, and as a prop for staged shows for or by children acting out puppet themes and motifs.

The right sleeve 18 may terminate in a cuff-like portion 38 as shown in FIGS. 1 and 2 which may enclose the right hand, or preferably the right distal portion 38 is open to permit the right hand to protrude from the sleeve when desired, as best seen in FIG. 3.

Preferably, the puppet head 30 will extend from the lower portion of the sleeve 20 at its distal end in one continuous piece of material, although separate pieces of material appropriately sewn together, or otherwise fastened will also be suitable. The specific shape of the puppet head extension will be determined by the type of animal depicted on the particular shirt. Modifications such as slightly padded areas, extra seams, and separate ear pieces will be or might be needed to give a proper shape to certain of the pet heads.

As best seen in FIG. 3, when not in use, the puppet head sleeve 20 can be retracted by pushing the sleeve back up onto the forearm of the wearer, so that the hand of the wearer is exposed. The hand of the wearer will slip through a mouth hole 50 at the back of the formed mouth of the puppet head 30. The puppet head sleeve can then be secured in place around the wrist of the wearer by fastening a suitable fastener such as a snap button, or preferably by VELCRO brand tabs **52*a*, 54*a* located at the inner side of the upper mouth piece 56 and at the outer edge of the lower mouth piece 58 at the tabs 52*b*, 54*b***. This retractable design allows the wearer to keep the continuity of the animal design while not using the puppet head.

FIG. 3 is also representative of another design applied to the garment 10. As shown in FIG. 3, the design is that of a dinosaur-type creature having its head at the distal end of the left sleeve and its tail on the right sleeve 18, while its body is located on the torso portion of the garment 10.

FIGS. 4 and 5 depict in greater detail the internal mouth structure of the puppet head as previously described.

FIGS. 6 and 7 illustrate respectively the use of the hand inside the puppet, while FIG. 7 shows a cross sectional view taken along line 7—7 of FIG. 3 showing the hand extended from one sleeve.

FIG. 8, as previously mentioned, shows still another representative figure, i.e. that of a giraffe, showing its antlers 60 as a representative three-dimensional head configuration.

Finally, FIG. 9 shows a hooded version 70 of the pullover as an alternative embodiment when the hand puppet 28 is formed consistent with the character. In FIG. 9, a penguin is shown as an example of hooded characters.

Thus, a shirt design having a number of unique features is shown and described. The shirt can be manufactured with a minimum number of pieces, i.e. a regular front body piece 13; a back body piece 14, a regular sleeve piece 18, a puppet head sleeve piece 20, an upper inner mouth piece 56, and a lower inner mouth piece 58 as have been described.

While this invention has been described in conjunction with a specific embodiment, therefore, it is evident that many alternatives, modifications, and variations will be apparent to those skilled in the art. Accordingly, it is intended to embrace all alternatives, modifications, and variations that fall within the scope of the appended claims.

I claim:

1. An article of manufacture comprising:

a shirt-like garment having an upper body torso portion sized and configured to be worn about at least a portion of the upper body torso of a wearer and merging into a sleeve portion, at least said sleeve portion having applied thereto an artistic figure, wherein said sleeve portion includes a puppet head sleeve piece at its distal end, whereupon insertion of a hand of a wearer into said puppet head sleeve piece permits its manipulation in a manner similar to a conventional puppet, said puppet head sleeve piece defining a slot sized to permit a hand of a wearer to extend therethrough so that said other end of said sleeve can act either as a puppet head or as a cuff of said sleeve.

2. The article of manufacture as set forth in claim 1, wherein said puppet head sleeve piece includes an upper inner mouth piece and a lower inner mouth piece, together defining said slot therebetween so that a hand of a wearer can extend through said slot when not inserted into said puppet head sleeve piece.

3. The article of manufacture as set forth in claim 2, further including fastening members for securing said upper and lower inner mouth pieces.

4. The article of manufacture as set forth in claim 1, wherein said puppet head sleeve piece is formed as a head of a creature consistent with the figure applied to said torso portion.

5. The article of manufacture as set forth in claim 2, wherein said puppet head sleeve piece includes three-dimensional members such as ears, beaks, and the like.

6. The article of manufacture as set forth in claim 1, wherein said garment further includes a regular sleeve piece secured to said torso portion opposite said puppet head sleeve piece.

7. The article of manufacture as set forth in claim 1, wherein said torso portion of said garment includes a front body piece and a back body piece together defining said torso portion.

8. The article of manufacture as set forth in claim 7, wherein said image is formed on both of said front body piece and said back body piece.

9. The article of manufacture as set forth in claim 8, wherein said image simulates one of a flamingo, a snake, a dinosaur, an elephant, a giraffe, and the like.

10. The article of manufacture as set forth in claim 1, wherein said artistic figure continues from said sleeve portion to said torso portion, so that said puppet figure appears to continue from said sleeve portion to said torso portion.

11. A garment comprising:

a torso portion sized and structurally adapted to be worn on at least a portion of the upper body torso of a wearer;

a sleeve portion unitarily connected at an end to said torso portion and terminating at its other end in a puppet head sleeve piece formed as a head of a puppet figure and structurally adapted to receive therein a hand of a user, said puppet head sleeve piece defining a slot sized to permit a hand of a wearer to extend therethrough so that said other end of said sleeve can act either as a puppet head or as a cuff of said sleeve.

12. The garment as set forth in claim 11, wherein said puppet head sleeve piece is defined by a pair of flaps forming portions of said sleeve and forming upper and lower inner mouth pieces of said puppet.

13. The garment as set forth in claim 12, wherein said upper and lower inner mouth pieces are secured about at least a portion of their perimeter to define said slot through which a hand of a wearer may extend so that said garment can also be worn conventionally.

14. The garment as set forth in claim 11, wherein an artistic figure consistent with said head of said puppet figure is provided on said sleeve.

15. The garment as set forth in claim 14, wherein said artistic figure is also provided at least in part on said torso portion of said garment.

* * * * *